US012799861B2

(12) United States Patent
Samuel

(10) Patent No.: US 12,799,861 B2
(45) Date of Patent: Nov. 17, 2026

(54) SYMBOLIC DYNAMICS FOR WELLBORE OPERATION

(71) Applicant: Landmark Graphics Corporation, Houston, TX (US)

(72) Inventor: Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 396 days.

(21) Appl. No.: 18/229,741

(22) Filed: Aug. 3, 2023

(65) Prior Publication Data

US 2025/0043678 A1 Feb. 6, 2025

(51) Int. Cl.
*E21B 47/14* (2006.01)
*E21B 44/00* (2006.01)

(52) U.S. Cl.
CPC ..... *E21B 47/14* (2013.01); *E21B 44/00* (2013.01); *E21B 2200/20* (2020.05)

(58) Field of Classification Search
None
See application file for complete search history.

(56) References Cited

U.S. PATENT DOCUMENTS

2014/0352950 A1 12/2014 Hallundbæk
2017/0090457 A1 3/2017 Pandurangan et al.
2017/0167245 A1 6/2017 Dickenson et al.
2018/0038216 A1 2/2018 Zhang et al.
2018/0284313 A1 10/2018 Hu et al.
2024/0118685 A1* 4/2024 Weber ..... G05B 23/0229

FOREIGN PATENT DOCUMENTS

CN 111397896 A * 7/2020 ..... G06F 18/214
JP H05312634 A * 11/1993
JP H0696234 A * 4/1994
JP H06273286 A * 9/1994

OTHER PUBLICATIONS

A. Khatkhate, A. Ray, E. Keller, S. Gupta and S. C. Chin, "Symbolic time-series analysis for anomaly detection in mechanical systems," in IEEE/ASME Transactions on Mechatronics, vol. 11, No. 4, pp. 439-447, Aug. 2006, doi: 10.1109/TMECH.2006.878544 (Year: 2006).*

(Continued)

*Primary Examiner* — Lina Cordero
(74) *Attorney, Agent, or Firm* — Kilpatrick Townsend & Stockton LLP

(57) ABSTRACT

A system can be used to analyze a wellbore operation using symbolic dynamics. The system can receive baseline data and subsequent data about a downhole tool. The system can transform the baseline data and the subsequent data into symbolic representations thereof. The system can determine, using symbolic dynamics to compare the symbolic representations, a degree of difference between the symbolic representations. The system can provide the degree of difference between the symbolic representations via an output device. The degree of difference can be used to control the wellbore operation.

17 Claims, 4 Drawing Sheets

(56) References Cited

OTHER PUBLICATIONS

D. Friedlander, I. Chattopadhyay, A. Ray, S. Phoha and N. Jacobson, "Anomaly prediction in mechanical systems using symbolic dynamics," Proceedings of the 2003 American Control Conference, 2003., Denver, CO, USA, 2003, pp. 4275-4280 vol. 5, doi: 10.1109/ACC2003.1240508 (Year: 2003).*

Asok Ray, "Symbolic dynamic analysis of complex systems for anomaly detection," Signal Processing, vol. 84, Issue 7, 2004, pp. 1115-1130, ISSN 0165-1684, https://doi.org/10.1016/j.sigpro.2004.03.011 (Year: 2004).*

JPH06273286A translation (Year: 1994).*

JPH0696234A translation (Year: 1994).*

JPH05312634A translation (Year: 1993).*

Medina, R., Macancela, JC., Lucero, P. et al. Vibration signal analysis using symbolic dynamics for gearbox fault diagnosis. Int J Adv Manuf Technol 104, 2195-2214 (2019). https://doi.org/10.1007/s00170-019-03858-0 (Year: 2019).*

Devendra Tolani, Symbolic Time Series Analysis (STSA) for Anomaly Detection, NIST (Year: 2005).*

CN111397896A translation (Year: 2020).*

International Patent Application No. PCT/US2023/029365, International Search Report and Written Opinion mailed May 1, 2024, 9 pages.

Guzzetti, Stefano , et al., "Symbolic Dynamics of Heart Rate Variability", Apr. 12, 2005, pp. 465-470.

* cited by examiner

SYMBOLIC DYNAMICS FOR WELLBORE OPERATION

TECHNICAL FIELD

The present disclosure relates generally to wellbore operations and, more particularly (although not necessarily exclusively), to symbolic dynamics for a wellbore operation.

BACKGROUND

Wellbore operations may include various equipment, components, methods, or techniques to form a wellbore, to displace and release hydrocarbon fluids using a wellbore or flowline, and the like. One particular example of the wellbore operations can include a drilling operation that can be used to form a wellbore. The various equipment may break down or experience a failure, may require periodic maintenance, or the like during the wellbore operations. Predicting when the various equipment may experience a failure or otherwise predicting a time to perform maintenance or repair may be difficult.

DETAILED DESCRIPTION

Figure 1:
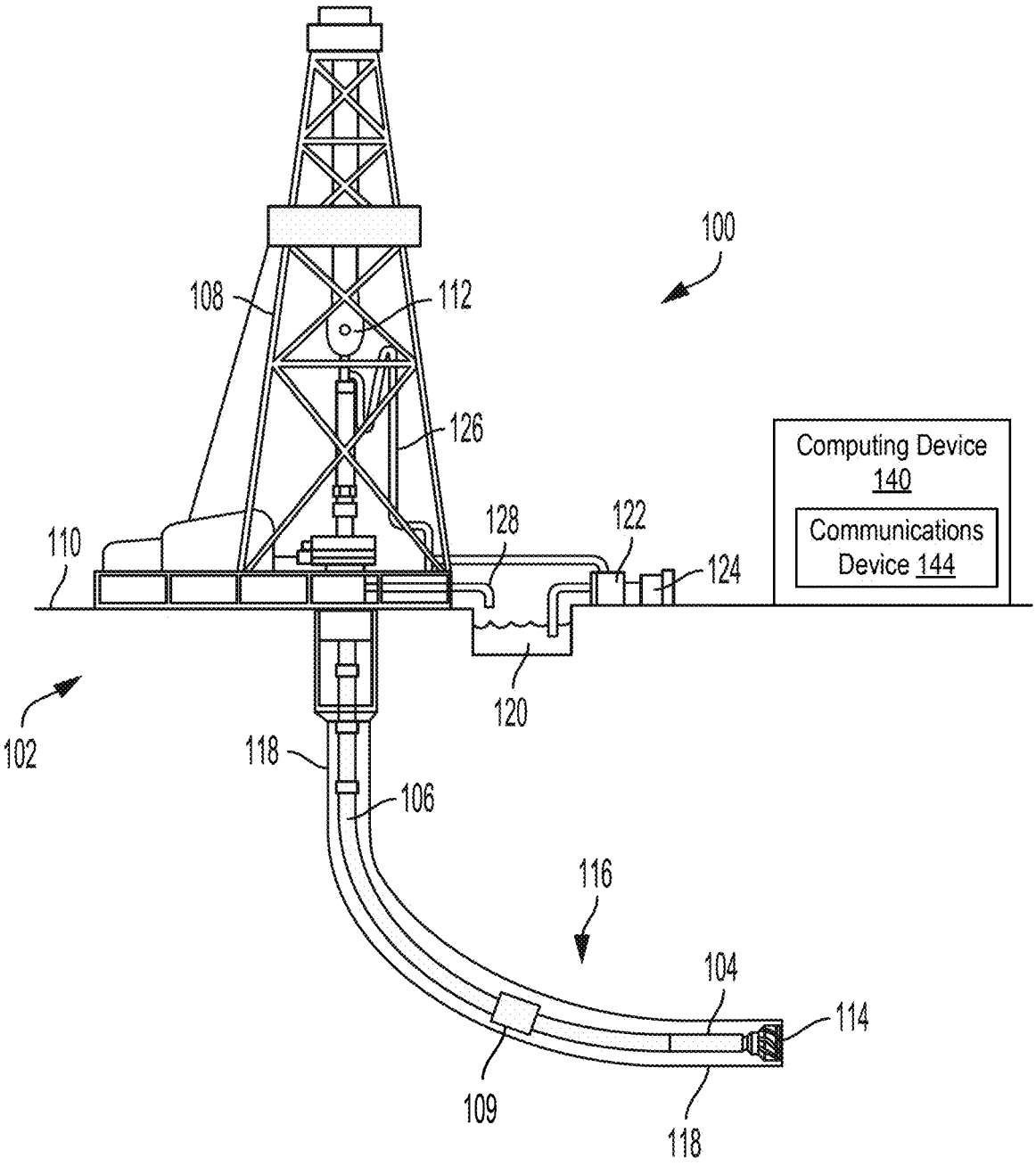
FIG. 1 is a sectional view of a wellbore-drilling system including a wellbore formed by a drilling operation that can be analyzed using symbolic dynamics according to one example of the present disclosure.

Certain aspects and examples of the present disclosure relate to symbolic dynamics for analyzing a wellbore operation. The wellbore operation may be or include a wellbore drilling operation, a wellbore completion operation, a wellbore stimulation operation, a wellbore production operation, or any other suitable wellbore operation that may use wellbore equipment. Analyzing the wellbore operation may involve analyzing equipment used in the wellbore operation to determine if the equipment is functioning properly, to determine if the equipment is due for maintenance, to determine if the equipment is associated with an anomaly indicating that the equipment may be likely to experience a failure during a predetermined time window, and the like. Analyzing the wellbore operation may involve using symbolic dynamics to analyze the equipment associated with the wellbore operation. Symbolic dynamics may include democratized symbolic dynamics or any other suitable variation of symbolic dynamics that can be used to analyze the equipment. The symbolic dynamics can be used to determine whether an anomaly is present with respect to the equipment. An output of the symbolic dynamics analysis (i) can be provided to an operator of the wellbore operation to advise how to control the wellbore operation, (ii) can be used to control the wellbore operation, or a combination thereof.

Wellbore systems, such as wellbore drilling systems, wellbore completion systems, wellbore stimulation systems, wellbore production systems, wellbore abandonment systems, and the like, can be complicated systems. In such complicated systems, early detection of anomalies can allow corrective actions to be performed (i) to avoid catastrophic events that may lead to damage, resource loss, and other negative consequences and (ii) to enhance an efficiency or productivity of the respective system. Mathematically modeling the complicated systems may be difficult due to the complexity of mathematics (e.g., the non-linearity of the system) used to model a system, the limited availability of data for the system, and the like. Sensor data and other suitable data can be used to model at least a portion of the complicated system. But, data noise contamination, exogenous disturbances, environmental uncertainties, and the like may increase a complexity or difficulty of modeling the complicated system with accuracy or precision. Additionally or alternatively, the complicated systems may be dynamic, nonlinear, non-stationary, or any combination thereof.

A symbolic language can be used to model a complicated system used in a wellbore operation. A phase space description, which can involve the symbolic language, can be generated to represent the dynamic behavior of the complicated system in the absence of, or in the presence of, anomalies of interest. The phase space description, the symbolic language, or a combination thereof can be used to detect anomalies with respect to the complicated system in real-time or otherwise substantially contemporaneously.

A system can be used to detect anomalies in a complicated system using a phase space description of the complicated system, a symbolic language, or a combination thereof. The system can use techniques relating to language theory, nonlinear systems theory, other suitable theories, or any combination thereof. The system can apply the techniques to one or more types of complicated systems, such as dynamically nonlinear systems, that may be associated with a slow time scale, a fast time scale, or a combination thereof. With respect to the slow time scale, which may be larger than the fast time scale by one order of magnitude, two orders of magnitude, three orders of magnitude, or more orders of magnitude, the system may detect one or more anomalies. Additionally or alternatively, the complex system may be quasistatic on the fast time scale. The symbolic language may be used to derive a functional relationship between a total variance of the complicated system and a detection time of one or more detected anomalies of the complicated system. In some examples, a damage anomaly may be associated with a sudden shift in variance of the complicated system.

In some examples, the system can use symbolic dynamics to analyze the complicated system of the wellbore operation. Symbolic dynamics may be or include democratized symbolic dynamics, which may involve n two-time-scale analysis of time-series data and may involve a combination of nonlinear systems theory and language theory. The symbolic dynamics can be used to identify a potential anomaly in the complicated system. In a particular example in which the complicated system is a wellbore drilling operation, the symbolic dynamics can identify a baseline data signal and can identify a second or subsequent data signal. Symbols can be applied to the baseline data signal, the second data signal, or a combination thereof, and the symbols may represent a magnitude of data points included in the baseline data signal or the second data signal, may represent a change in the baseline data signal or the second data signal, or the like.

The baseline data signal can be compared to the second data signal to determine a degree of difference. For example, an entropy, such as an entropy based on a Reyni entropy, etc., can be determined between or for the baseline data signal and the second data signal. If the degree of difference does not increase, then the system may determine that no anomalies exist in the complicated system or otherwise that the complicated system is functioning properly. If the degree of difference does increase, the system may determine a likelihood that an anomaly exists in the complicated system based at least in part on a magnitude of increase of the entropy. For example, if the entropy increases above a threshold value, then the system may determine that an anomaly exists in the complicated system.

In some examples, the operations or techniques described herein may be used to control a wellbore operation based on analysis performed on an offset well. In a particular example, a live wellbore drilling operation can be controlled based on analysis of drilling data of an offset well, though other suitable types of wellbore operations can be used in addition to, or alternative to, the wellbore drilling operation. The symbolic dynamics can be used to analyze the drilling data of the offset well, and the analyzed drilling data can be used to control the live wellbore drilling operation.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional view of a wellbore-drilling system 100 including a wellbore 118 formed by a drilling operation that can be analyzed using symbolic dynamics according to one example of the present disclosure. While FIG. 1 is illustrated as a system for a wellbore drilling operation, other suitable wellbore operations are also possible. The wellbore 118 used to extract hydrocarbons may be created by drilling into a subterranean formation 102 using the wellbore-drilling system 100. The wellbore-drilling system 100 may drive a bottom hole assembly (BHA) 104 positioned or otherwise arranged at the bottom of a drill-string 106 extended into the subterranean formation 102 from a derrick 108 arranged at the surface 110. The derrick 108 includes a kelly 112 used to lower and raise the drill-string 106. The BHA 104 may include a drill bit 114 operatively coupled to a tool string 116, which may be moved axially within a drilled wellbore 118 as attached to the drill-string 106. The tool string 116 may include one or more sensors 109, such as vibration sensors, other suitable downhole sensors, etc., for determining conditions in the wellbore 118. The sensors 109 may be positioned on drilling equipment, which may be deployed downhole in the wellbore 118, and which may sense values of drilling parameters for a drilling operation. The sensors 109 can send real-time signals to the surface 110 via a wired connection or a wireless connection, and the sensors 109 may send real-time data relating to the drilling operation to the surface 110. The combination of any support structure, such as the derrick 108, any motors, electrical equipment, and support for the drill-string and tool string may be referred to herein as a drilling arrangement.

During operation, the drill bit 114 can penetrate the subterranean formation 102 to create the wellbore 118. The BHA 104 can provide control of the drill bit 114 as the drill bit 114 advances into the subterranean formation 102. The combination of the BHA 104 and the drill bit 114 can be referred to as a drilling tool, though other suitable drilling tools are possible. Fluid or "mud" from a mud tank 120 may be pumped downhole using a mud pump 122 powered by an adjacent power source such as a prime mover or motor 124. The mud may be pumped from the mud tank 120, through a stand pipe 126, which can feed the mud into the drill-string 106 and conveys the same to the drill bit 114. The mud exits one or more nozzles arranged in the drill bit 114 and, in the process, cools the drill bit 114. After exiting the drill bit 114, the mud can circulate back to the surface 110 via the annulus, which may be defined between the wellbore 118 and the drill-string 106, and hole cleaning can occur, which may involve returning drill cuttings and debris to the surface 110. The cuttings and mud mixture can be passed through a flow line 128 and can be processed such that cleaned mud can be returned downhole through the stand pipe 126 once again.

The drilling arrangement and any sensors 109 (through the drilling arrangement or directly) may be communicatively coupled to a computing device 140. The computing device 140 may be configured to determine a degree of difference between a baseline signal and a subsequent signal for a downhole tool, such as the drill bit 114, for advising the drilling operation, for controlling the drilling operation, or for a combination thereof. In FIG. 1, the computing device 140 is illustrated as being deployed at the surface 110 of the wellbore-drilling system 100. In some examples, the computing device 140, which may receive data from the sensors 109 and may control the drill bit 114, can be permanently installed with the drilling arrangement, can be positioned downhole (e.g., on the drill bit 114, etc.), can be hand-held, can be remotely located, etc. Although one computing device (e.g., the computing device 140) is depicted in FIG. 1, in other examples, more than one computing device can be used, and together, the multiple computing devices can perform operations such as those described herein.

The computing device 140 can be positioned belowground, aboveground, onsite, in a vehicle, offsite, etc. The computing device 140 can include a processor interfaced with other hardware via a bus. A memory, which can include any suitable tangible (and non-transitory) computer-readable medium, such as random-access memory ("RAM"), read-only memory ("ROM"), electrically erasable and programmable read-only memory ("EEPROM"), or the like, can embody program components that configure operation of the computing device 140. In some aspects, the computing device 140 can include input/output interface components (e.g., a display, printer, keyboard, touch-sensitive surface, and mouse) and additional storage.

The computing device 140 can include a communication device 144. The communication device 144 can represent one or more of any components that can facilitate a network connection. In some examples, the communication device 144 can be wireless and can include wireless interfaces such as IEEE 802.11, Bluetooth™, or radio interfaces for accessing cellular telephone networks such as a transceiver/antenna for accessing a CDMA, GSM, UMTS, or other mobile communications network. In some examples, the communication device 144 can use acoustic waves, surface waves, vibrations, optical waves, or induction (e.g., magnetic induction) for engaging in wireless communications. In other examples, the communication device 144 can be wired and can include interfaces such as Ethernet, USB, IEEE 1394, a fiber optic interface, or any combination thereof. In an example with at least one other computing device, the computing device 140 can receive wired or wireless communications from the other computing device and perform one or more tasks based on the communications.

Figure 2:
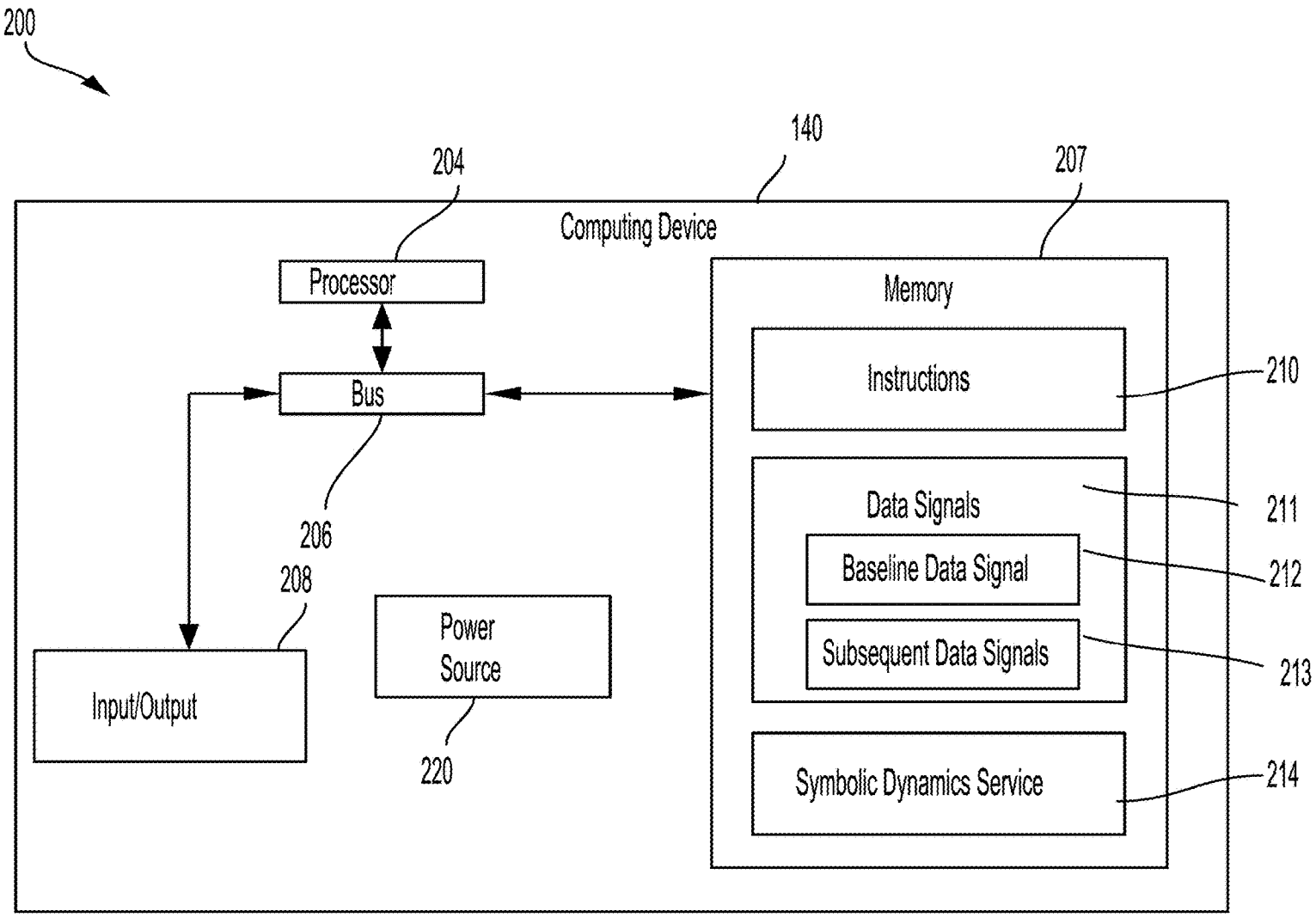
FIG. 2 is a block diagram of a computing device for analyzing a wellbore operation using symbolic dynamics according to one example of the present disclosure.

FIG. 2 is a block diagram 200 of a computing device 140 for analyzing a wellbore operation using symbolic dynamics according to one example of the present disclosure. The components, such as processor 204, memory 207, power source 220, input/output 208, and the like, illustrated in FIG. 2 may be integrated into a single structure such as within a single housing of the computing device 140. In some examples, the components illustrated in FIG. 2 can be distributed from one another and may be in electrical communication with each other.

The computing device 140 can include the processor 204, the memory 207, and a bus 206, among other suitable components for the computing device 140. The processor 204 can execute one or more operations for performing symbolic dynamics-based operations on data signals received with respect to a wellbore operation. The processor 204 can execute computer-program instructions 210 stored in the memory 207 to perform the operations. The processor 204 can include one processing device or multiple processing devices or cores. Non-limiting examples of the processor 204 can include a field-programmable gate array ("FPGA"), an application-specific integrated circuit ("ASIC"), a microprocessor, and the like.

The processor 204 can be communicatively coupled to the memory 207 via the bus 206. The memory 207 may be or include non-volatile memory and may include any type of memory device that retains stored information when powered off. Non-limiting examples of non-volatile forms of the memory 207 may include EEPROM, flash memory, or any other type of non-volatile memory. In some examples, at least part of the memory 207 can include a medium from which the processor 204 can read computer-program instructions 210. A computer-readable medium can include electronic, optical, magnetic, or other storage devices capable of providing the processor 204 with computer-readable instructions or other program code. Non-limiting examples of a computer-readable medium may include magnetic disk(s), memory chip(s), ROM, RAM, an ASIC, a configured processor, optical storage, or any other medium from which a computer processor can read computer-program instructions 210. The computer-program instructions 210 can include processor-specific instructions generated by a compiler or an interpreter from code written in any suitable computer-programming language, including, for example, C, C++, C#, Perl, Java, Python, etc.

In some examples, the memory 207 can be a non-transitory computer readable medium and can include computer-program instructions 210. For example, the computer-program instructions 210 can be executed by the processor 204 for causing the processor 204 to perform various operations. For example, the processor 204 can receive data signals 211 that represent data detected or otherwise received with respect to a wellbore operation. The data signals 211 can include a baseline data signal 212 and one or more subsequent data signals 213. Additionally or alternatively, the processor 204 may access or execute a symbolic dynamics service 214 that may perform one or more operations using the data signals 211. In some examples, the one or more operations may include transforming the baseline data signal 212, the one or more subsequent data signals 213, or a combination thereof into one or more symbolic representations of data signals. Additionally or alternatively, the one or more operations may include using the data signals 211, or any representations thereof, to determine a degree of difference between data signals, to determine whether an anomaly exists in the wellbore operation based on the degree of difference, and the like. The processor 204 can provide the degree of difference, the determination with respect to the anomaly, or a combination thereof for controlling the wellbore operation. For example, the processor 204 can output the degree of difference, the determination with respect to the anomaly, or a combination thereof (i) to a display device for advising about the wellbore operation, or (ii) to a control module to control the wellbore operation, etc.

The computing device 140 can additionally include an input/output 208. The input/output 208 can connect to a keyboard, a pointing device, a display, other computer input/output devices or any combination thereof. An operator may provide input using the input/output 208. Data relating to the wellbore 118, equipment thereof (e.g., the drill bit 114), the wellbore operation, or any combination thereof can be displayed to an operator of a wellbore operation through a display that is connected to or is part of the input/output 208. The displayed values can be observed by the operator, or by another suitable user, of the wellbore operation, who can adjust the wellbore operation based on the output. Additionally or alternatively, the computing device 140 can automatically control or adjust the wellbore operation based on the output.

Figure 3:
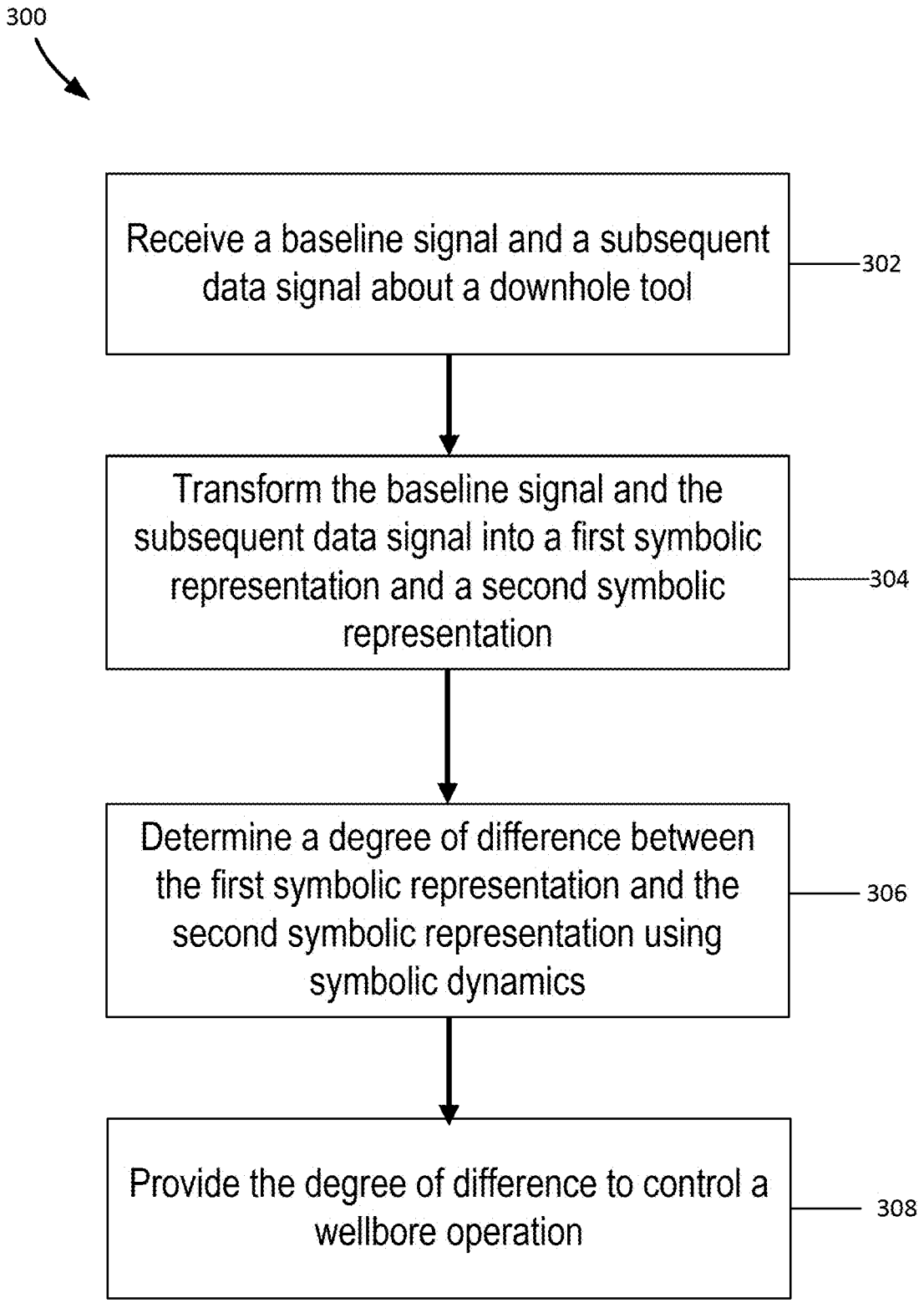
FIG. 3 is a flowchart of a process for analyzing a wellbore operation using symbolic dynamics according to one example of the present disclosure.

FIG. 3 is a flowchart of a process 300 for analyzing a wellbore operation using symbolic dynamics according to one example of the present disclosure. In some examples, the process 300 for analyzing the wellbore operation using symbolic dynamics, or any other suitable operation described herein, can be performed by the computing device 140, for example when operators are operating the wellbore operation. In other examples, the process 300 for analyzing the wellbore operation using symbolic dynamics can be performed by the computing device 140 while the wellbore operation is being operated by an autonomous rig or other suitable automated equipment.

At block 302, the computing device 140 receives a baseline data signal and a subsequent data signal about a downhole tool. The downhole tool may be or include a wellbore drilling tool, a wellbore completion tool, a wellbore stimulation tool, or any other suitable tool that can be positioned or used in a wellbore. The baseline data signal and the subsequent data signal may be similar or identical types of data signals. For example, the baseline data signal may be or include a vibration data signal, and the subsequent data signal may be or include a vibration data signal. Other suitable data signals, such as those detected by other downhole sensors, can be used as the baseline data signal, the subsequent data signal, or a combination thereof. Additionally or alternatively, the subsequent data signal may be or include more than one, such as two, three, four, five, or more, data signal.

In a particular example, the downhole tool may be a wellbore drilling tool, and the computing device 140 can measure or otherwise receive vibration data relating to the wellbore drilling tool drilling a wellbore. A baseline vibration data signal, which may be or include expected vibration data about the wellbore drilling tool, historical vibration data about the wellbore drilling tool, or the like, can be received, for example from a calibrated well engineering model or other suitable sources, about the wellbore drilling tool. A subsequent vibration data signal, which may be or include real-time or approximately real-time vibration data about the wellbore drilling tool, can be received about the wellbore drilling tool.

At block 304, the computing device 140 transforms the baseline data signal and the subsequent data signal into symbolic representations of the baseline data signal and the subsequent data signal. In some examples, the computing device 140 can transform the baseline data signal into a first symbolic representation, and the computing device 140 can transform the subsequent data signal into a second symbolic representation. The computing device 140 may use symbolic dynamics, such as democratized symbolic dynamics or other analytics, such as nonlinear systems theory, language theory, and the like, to transform the baseline data signal and the subsequent data signal into the first symbolic representation and the second symbolic representation, respectively.

In some examples, the computing device 140 can transform data points from the baseline data signal and data points from the subsequent data signal into symbols representing corresponding data points. The symbols may be numbers, letters (e.g., from any suitable language), or other suitable symbols that can be used to represent the corresponding data points. The computing device 140 can use the same or similar types of symbols to transform the baseline data signal and the subsequent data signal. For example, if numbers are used to transform the baseline data signal to the first symbolic representation, then numbers may also be used to transform the subsequent data signal into the second symbolic representation. Coarse patterns, which may not have been apparent prior to the computing device 140 transforming the baseline data signal and the subsequent data signal, may be inferred from the first symbolic representation and the second symbolic representation.

In some examples, a phase space occupied by the baseline data signal and the subsequent data signal, or by the first symbolic representation and the second symbolic representation, can be partitioned into multiple sequences of data points or symbols. For example, if the baseline data signal includes 30 separate data points, then the computing device 140 may transform the 30 separate data points into 30 separate symbols grouped into a set of sequences. In a particular example, the computing device 140 can group the 30 separate symbols into approximately 28 different sequences of length-three symbol sequences, though other suitable numbers (e.g., less than 28 or more than 28) of sequences or other suitable sizes (e.g., less than three or more than three) of sequences are possible.

At block 306, the computing device 140 determines a degree of difference between the first symbolic representation and the second symbolic representation. The computing device 140 may determine the degree of difference by comparing the first symbolic representation with the second symbolic representation. In some examples, the computing device 140 can determine an entropy between the first symbolic representation and the second symbolic representation. The entropy may be or include a Reyni entropy or any other suitable entropy value that can be used to determine the degree of difference between the first symbolic representation and the second symbolic representation, or any subsets thereof.

The entropy may be determined between sequences of symbols partitioned by the computing device 140. For example, a first sequence of symbols from the first symbolic representation can be compared with a second sequence of symbols from the second symbolic representation, and the entropy, or other suitable degree of difference, can be determined between the first sequence and the second sequence. The degree of difference may additionally or alternatively represent a magnitude of difference between the first sequence and the second sequence. The computing device 140 may iteratively determine a set of degrees of difference between subsequent sequences of the first symbolic representation and the second symbolic representation. The computing device 140 may use at least a subset of the set of degrees of difference and the degree of difference to determine an aggregate degree of difference or determine a degree of difference between the first symbolic representation and the second symbolic representation.

The degree of difference may be used by the computing device 140 to perform tool failure analysis or other suitable operations with respect to the downhole tool or the wellbore operation. For example, if the degree of difference exceeds a threshold value, the computing device 140 may determine that an anomaly is likely to be present in the downhole tool, in the wellbore operation, or in a combination thereof. In a particular example, if the degree of difference between the first symbolic representation and the second symbolic representation exceeds two or three standard deviations, then the computing device 140 may determine that failure of the downhole tool may be imminent, may be likely to occur within a specified period of time, or the like. Failure of the downhole tool may involve damage to the downhole tool from continuing the wellbore operation, damage to the wellbore from continuing the wellbore operation, an unsuccessfully completed wellbore operation, and the like.

At block 308, the computing device 140 provides the degree of difference to control a wellbore operation. The computing device 140 can output the degree of difference to a display device, to a controller, or to other suitable devices for providing the degree of difference. For example, the degree of difference can be output to a display device to display the degree of difference to provide insight about the wellbore operation, provide advice about the wellbore operation, and the like to an operator of the wellbore operation to facilitate decisions about the wellbore operation. In another example, the computing device 140 can output the degree of difference to a controller that can automatically control the wellbore operation, such as via controlling the downhole tool, using the degree of difference.

In some examples, the computing device 140 may use the degree of difference to make one or more inferences about the wellbore operation or the downhole tool, and the computing device 140 may provide, such as via an output to the display device, to the controller, and the like, the one or more inferences. In a particular example, the computing device 140 can determine that an anomaly exists in the downhole tool, and the computing device 140 can output an indication of the anomaly to the display device, to the controller, or a combination thereof. The anomaly may be or include damage to the downhole tool, maintenance due for the downhole tool, damage to the wellbore, a malfunction of the downhole tool, or the like. In some examples, the computing device 140 can determine a level of risk associated with continuing the wellbore operation with the anomaly present, and the computing device 140 can output the level of risk (i) to the output device to provide advice to the operator of the wellbore operation, (ii) to the controller for controlling the wellbore operations, or a combination thereof.

Figure 4:
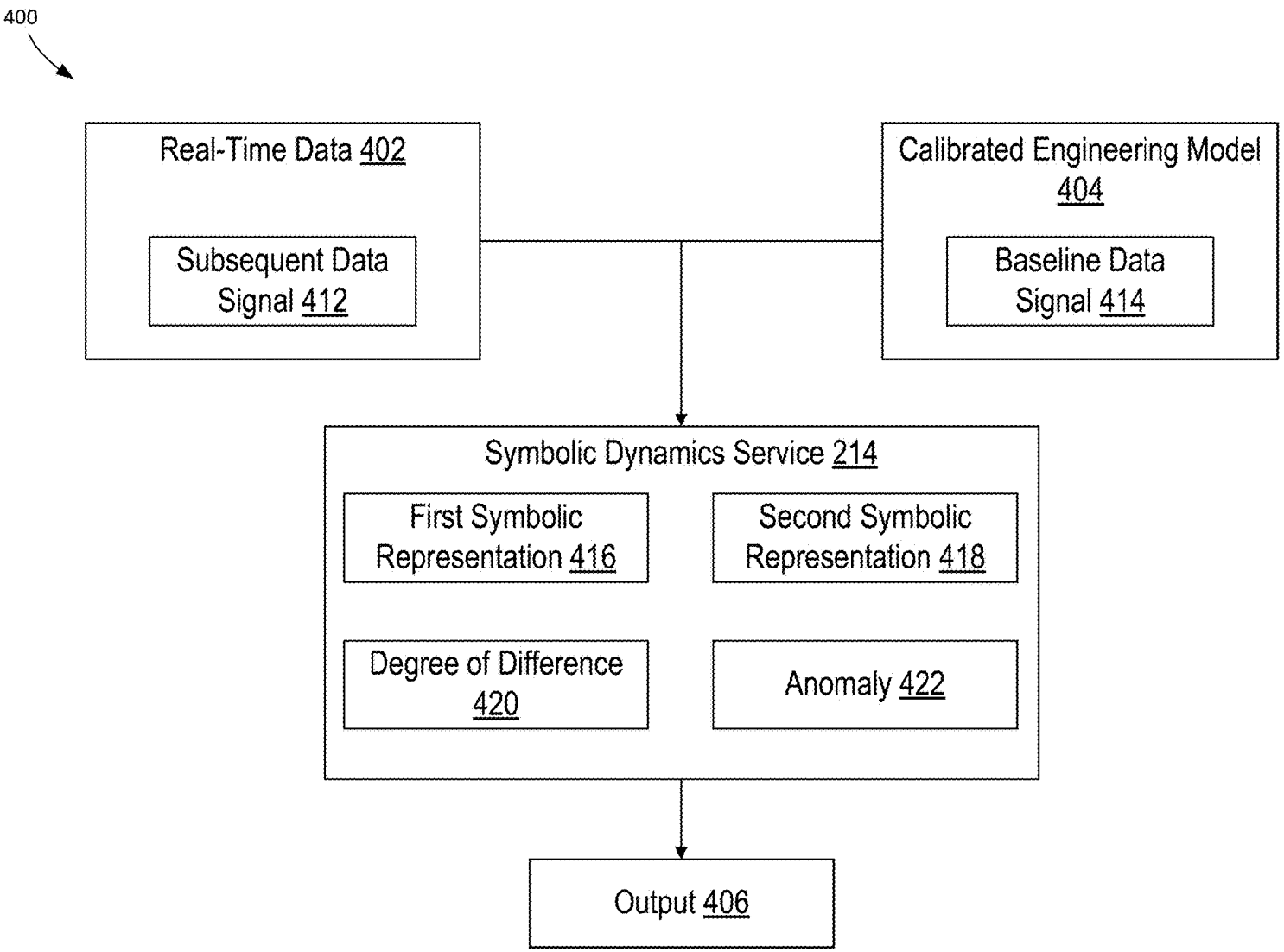
FIG. 4 is a data flow diagram of data flow with respect to analyzing a wellbore operation using symbolic dynamics according to one example of the present disclosure.

FIG. 4 is a data flow diagram 400 of data flow with respect to analyzing a wellbore operation using symbolic dynamics according to one example of the present disclosure. The data flow diagram 400 may begin with real-time data 402. The real-time data 402 may be received from a real-time data stream or from other suitable sources such as from one or more sensors positioned in the wellbore of the wellbore operation, positioned on the downhole tool, or the like. Additionally or alternatively, the real-time data 402 may include a subsequent data signal 412, which may include one or more data signals measured in approximate real-time from the downhole tool. The data flow diagram 400 may additionally or alternatively include a calibrated engineering model 404, which may have previously been calibrated, optimized, and the like. The calibrated engineering model 404 may include or otherwise provide a baseline data signal 414 for the downhole tool.

The baseline data signal 414 may be determined by the calibrated engineering model 404, for example, via a trained physics-based model, a trained machine-learning model, an untrained model, and the like. The baseline data signal 414 may represent an expected data signal, a historical data signal, and the like for the downhole tool in the wellbore operation. In some examples, the baseline data signal 414 may be or include (i) a vibration data signal that may represent a vibration signal associated with expected or historical operation of the downhole tool, (ii) a temperature data signal that may represent a temperature signal associated with expected or historical operation of the downhole tool, or the like. Additionally or alternatively, the subsequent data signal 412 may be the same or similar type of data signal as the baseline data signal 414. For example, if the baseline data signal 414 is a vibration data signal, then the subsequent data signal 412 may additionally be a vibration data signal. Additionally or alternatively, if the baseline data signal 414 is a temperature data signal, then the subsequent data signal 412 may additionally be a temperature data signal. The subsequent data signal 412 may be a real-time-measured data signal from the downhole tool. For example, if the subsequent data signal 412 is a vibration data signal, then the subsequent data signal 412 may be streamed in approximate real-time from a vibration sensor, from a computing device communicatively coupled with the vibration sensor, and the like.

The real-time data 402 and the calibrated engineering model 404 may be communicatively coupled with the symbolic dynamics service 214. For example, the computing device 140 may include or otherwise execute the symbolic dynamics service 214, and the computing device 140 may access or otherwise receive (i) the baseline data signal 414 from the calibrated engineering model 404, and (ii) the subsequent data signal 412 from the real-time data 402. The symbolic dynamics service 214 can receive the baseline data signal 414 and the subsequent data signal 412 as input and can transform the baseline data signal 414 and the subsequent data signal 412 into a first symbolic representation 416 and a second symbolic representation 418, respectively. The symbolic dynamics service 214 can use a particular set of symbols, such as numbers, letters of a particular language, or the like to transform the baseline data signal 414 and the subsequent data signal 412 into the first symbolic representation 416 and the second symbolic representation 418, respectively. Additionally or alternatively, the symbolic dynamics service 214 can segment the first symbolic representation 416 and the second symbolic representation 418 each into sequences of a subset of first symbolic representation 416 and the second symbolic representation 418, respectively. For example, the symbolic dynamics service 214 can segment the first symbolic representation 416 into n number of length three sequences, though other suitable numbers (e.g., less than three or more than three) are possible for the length of the first symbolic representation 416. Additionally or alternatively, the symbolic dynamics service 214 can segment the second symbolic representation 418 into n number of length three sequences, though other suitable numbers (e.g., less than three or more than three) are possible for the length of the second symbolic representation 418.

The symbolic dynamics service 214 can use the first symbolic representation 416 and the second symbolic representation 418 to determine a degree of difference 420. The degree of difference 420 may be a measure of how different the first symbolic representation 416 and the second symbolic representation 418 are with respect to one another. For example, the symbolic dynamics service 214 can determine an entropy between the first symbolic representation 416 and the second symbolic representation 418, or can determine other suitable degrees of difference between the first symbolic representation 416 and the second symbolic representation 418 to determine the degree of difference 420.

In some examples, the symbolic dynamics service 214 can use the degree of difference 420 to determine whether an anomaly 422 is present with respect to the downhole tool, with respect to the wellbore operation, or a combination thereof. The symbolic dynamics service 214 can apply a threshold difference to the degree of difference 420, and, if the degree of difference exceed the threshold difference, then the symbolic dynamics service 214 may determine that the anomaly 422 may be likely to exist in the downhole tool, in the wellbore operation, or in a combination thereof. In some example, the anomaly 422 may be or include damage to the downhole tool, a malfunction in the downhole tool, damage to the wellbore in which the downhole tool is disposed, damage or unexpected conditions with respect to an environment surrounding the wellbore, or any other anomalies that may jeopardize a successful completion of the wellbore operation. Additionally or alternatively, the symbolic dynamics service 214 may determine a level of risk associated with the anomaly 422. For example, the symbolic dynamics service 214 can determine whether the anomaly 422 presents a low risk, a medium risk, a high risk, or other levels of risk associated with continuing the wellbore operation with the anomaly 422 present.

The symbolic dynamics service 214 can generate an output 406 based at least in part on the degree of difference 420, on the anomaly 422, or on a combination thereof. For example, the symbolic dynamics service 214 can generate the output 406 to be provided via an output device such as a display device. The symbolic dynamics service 214 can cause the output device to provide the output 406 to provide advice to an operator of the wellbore operation to facilitate decisions about the wellbore operation. Additionally or alternatively, the symbolic dynamics service 214 can transmit the output 406 to a controller that can be used to automatically control the wellbore operation based on the output 406. In a particular example, the symbolic dynamics service 214 can transmit the output 406 to the controller, and the controller can automatically, such as without intervention from an operator of the wellbore operation, adjust (e.g., alter functional parameters, make no change, stop the wellbore operation, etc.) the wellbore operation based on the output 406.

In some aspects, systems, methods, and non-transitory computer-readable mediums for analyzing a wellbore operation using symbolic dynamics are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processor; and a non-transitory computer-readable medium that includes instructions executable by the processor for causing the processor to perform operations comprising: receiving a baseline data signal about a downhole tool and a subsequent data signal about the downhole tool, the downhole tool positionable in a wellbore associated with a wellbore operation; transforming the baseline data signal and the subsequent data signal into a first symbolic representation of the baseline data signal and a second symbolic representation of the subsequent data signal, respectively; determining, using symbolic dynamics to compare the first symbolic representation to the second symbolic representation, a degree of difference between the first symbolic representation and the second symbolic representation; and providing the degree of difference between the first symbolic representation and the second symbolic representation via an output device, the degree of difference usable to control the wellbore operation.

Example 2 is the system of example 1, wherein the operation of determining the degree of difference between the first symbolic representation and the second symbolic representation comprises determining an entropy between the first symbolic representation and the second symbolic representation.

Example 3 is the system of example 1, wherein the baseline data signal includes a baseline vibration data signal that represents an expected vibration signal of the downhole tool, and wherein the subsequent data signal includes a subsequent vibration data signal that represents a measured vibration signal of the downhole tool during the wellbore operation.

Example 4 is the system of example 1, wherein the wellbore operation includes a wellbore drilling operation, wherein the downhole tool includes a wellbore drilling tool, wherein the baseline data signal includes a baseline vibration data signal of the wellbore drilling tool that represents an expected vibration signal of the wellbore drilling tool, and wherein the subsequent data signal includes a subsequent vibration data signal of the wellbore drilling tool that represents a measured vibration signal of the wellbore drilling tool during the wellbore drilling operation.

Example 5 is the system of any of examples 1-4, wherein the operation of determining the degree of difference between the first symbolic representation and the second symbolic representation comprises using democratized symbolic dynamics on at least two different time scales to determine the degree of difference.

Example 6 is the system of any of examples 1-4, wherein the operation of determining the degree of difference between the first symbolic representation and the second symbolic representation comprises determining, based at least in part on the degree of difference, whether an anomaly is present in the subsequent data signal.

Example 7 is the system of any of examples 1-4, wherein the operations further comprise controlling the wellbore operation using the degree of difference.

Example 8 is a method comprising: receiving, by a computing device, a baseline data signal about a downhole tool and a subsequent data signal about the downhole tool, the downhole tool positionable in a wellbore associated with a wellbore operation; transforming, by the computing device, the baseline data signal and the subsequent data signal into a first symbolic representation of the baseline data signal and a second symbolic representation of the subsequent data signal, respectively; determining, by the computing device and using symbolic dynamics to compare the first symbolic representation to the second symbolic representation, a degree of difference between the first symbolic representation and the second symbolic representation; and providing, by the computing device, the degree of difference between the first symbolic representation and the second symbolic representation via an output device, the degree of difference usable to control the wellbore operation.

Example 9 is the method of example 8, wherein determining the degree of difference between the first symbolic representation and the second symbolic representation comprises determining an entropy between the first symbolic representation and the second symbolic representation.

Example 10 is the method of example 8, wherein the baseline data signal includes a baseline vibration data signal that represents an expected vibration signal of the downhole tool, and wherein the subsequent data signal includes a subsequent vibration data signal that represents a measured vibration signal of the downhole tool during the wellbore operation.

Example 11 is the method of example 8, wherein the wellbore operation includes a wellbore drilling operation, wherein the downhole tool includes a wellbore drilling tool, wherein the baseline data signal includes a baseline vibration data signal of the wellbore drilling tool that represents an expected vibration signal of the wellbore drilling tool, and wherein the subsequent data signal includes a subsequent vibration data signal of the wellbore drilling tool that represents a measured vibration signal of the wellbore drilling tool during the wellbore drilling operation.

Example 12 is the method of any of examples 8-11, wherein determining the degree of difference between the first symbolic representation and the second symbolic representation comprises using democratized symbolic dynamics on at least two different time scales to determine the degree of difference.

Example 13 is the method of any of examples 8-11, wherein determining the degree of difference between the first symbolic representation and the second symbolic representation comprises determining, based at least in part on the degree of difference, whether an anomaly is present in the subsequent data signal.

Example 14 is the method of examples 8-11, further comprising controlling the wellbore operation using the degree of difference.

Example 15 is a non-transitory computer-readable medium comprising instructions that are executable by a processing device for causing the processing device to perform operations comprising: receiving a baseline data signal about a downhole tool and a subsequent data signal about the downhole tool, the downhole tool positionable in a wellbore associated with a wellbore operation; transforming the baseline data signal and the subsequent data signal into a first symbolic representation of the baseline data signal and a second symbolic representation of the subsequent data signal, respectively; determining, using symbolic dynamics to compare the first symbolic representation to the second symbolic representation, a degree of difference between the first symbolic representation and the second symbolic representation; and providing the degree of difference between the first symbolic representation and the second symbolic representation via an output device, the degree of difference usable to control the wellbore operation.

Example 16 is the non-transitory computer-readable medium of example 15, wherein the operation of determining the degree of difference between the first symbolic representation and the second symbolic representation comprises determining an entropy between the first symbolic representation and the second symbolic representation.

Example 17 is the non-transitory computer-readable medium of example 15, wherein the wellbore operation includes a wellbore drilling operation, wherein the downhole tool includes a wellbore drilling tool, wherein the baseline data signal includes a baseline vibration data signal of the wellbore drilling tool that represents an expected vibration signal of the wellbore drilling tool, and wherein the subsequent data signal includes a subsequent vibration data signal of the wellbore drilling tool that represents a measured vibration signal of the wellbore drilling tool during the wellbore drilling operation.

Example 18 is the non-transitory computer-readable medium of example 15, wherein the operation of determining the degree of difference between the first symbolic representation and the second symbolic representation comprises using democratized symbolic dynamics on at least two different time scales to determine the degree of difference.

Example 19 is the non-transitory computer-readable medium of example 15, wherein the operation of determining the degree of difference between the first symbolic representation and the second symbolic representation comprises determining, based at least in part on the degree of difference, whether an anomaly is present in the subsequent data signal.

Example 20 is the non-transitory computer-readable medium of example 15, wherein the operations further comprise controlling the wellbore operation using the degree of difference.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processor; and a non-transitory computer-readable medium that includes instructions executable by the processor for causing the processor to perform operations comprising:

receiving a baseline data signal about a downhole tool and a subsequent data signal about the downhole tool, the downhole tool positionable in a wellbore associated with a wellbore operation;

transforming the baseline data signal and the subsequent data signal into a first symbolic representation of the baseline data signal and a second symbolic representation of the subsequent data signal, respectively;

determining, using symbolic dynamics to compare the first symbolic representation to the second symbolic representation, a degree of difference between the first symbolic representation and the second symbolic representation; and controlling the wellbore operation in response to detecting an anomaly from the degree of difference, wherein controlling the wellbore operation comprises providing an output generatable from the degree of difference to a controller of a drill bit and automatically altering, using the output, at least one functional parameter of the drill bit for forming a second wellbore.

2. The system of claim 1, wherein the operation of determining the degree of difference between the first symbolic representation and the second symbolic representation comprises determining an entropy between the first symbolic representation and the second symbolic representation.

3. The system of claim 1, wherein the baseline data signal includes a baseline vibration data signal that represents an expected vibration signal of the downhole tool, and wherein the subsequent data signal includes a subsequent vibration data signal that represents a measured vibration signal of the downhole tool during the wellbore operation.

4. The system of claim 1, wherein the wellbore operation includes a second drilling operation, wherein the downhole tool includes a wellbore drilling tool, wherein the baseline data signal includes a baseline vibration data signal of the wellbore drilling tool that represents an expected vibration signal of the wellbore drilling tool, and wherein the subsequent data signal includes a subsequent vibration data signal of the wellbore drilling tool that represents a measured vibration signal of the wellbore drilling tool during the second drilling operation.

5. The system of claim 1, wherein the operation of determining the degree of difference between the first symbolic representation and the second symbolic representation comprises using democratized symbolic dynamics on at least two different time scales to determine the degree of difference.

6. The system of claim 1, wherein the operation of determining the degree of difference between the first symbolic representation and the second symbolic representation comprises determining, based at least in part on the degree of difference, whether the anomaly is present in the subsequent data signal.

7. A method comprising:

receiving, by a computing device, a baseline data signal about a downhole tool and a subsequent data signal about the downhole tool, the downhole tool positionable in a wellbore associated with a wellbore operation;

transforming, by the computing device, the baseline data signal and the subsequent data signal into a first symbolic representation of the baseline data signal and a second symbolic representation of the subsequent data signal, respectively;

determining, by the computing device and using symbolic dynamics to compare the first symbolic representation to the second symbolic representation, a degree of difference between the first symbolic representation and the second symbolic representation; and controlling the wellbore operation in response to detecting an anomaly from the degree of difference, wherein controlling the wellbore operation comprises providing an output generated from the degree of difference to a controller of a drill bit and automatically altering, using the output, at least one functional parameter of the drill bit for forming a second wellbore.

8. The method of claim 7, wherein determining the degree of difference between the first symbolic representation and the second symbolic representation comprises determining an entropy between the first symbolic representation and the second symbolic representation.

9. The method of claim 7, wherein the baseline data signal includes a baseline vibration data signal that represents an expected vibration signal of the downhole tool, and wherein the subsequent data signal includes a subsequent vibration data signal that represents a measured vibration signal of the downhole tool during the wellbore operation.

10. The method of claim 7, wherein the wellbore operation includes a second drilling operation, wherein the downhole tool includes a wellbore drilling tool, wherein the baseline data signal includes a baseline vibration data signal of the wellbore drilling tool that represents an expected vibration signal of the wellbore drilling tool, and wherein the subsequent data signal includes a subsequent vibration data signal of the wellbore drilling tool that represents a measured vibration signal of the wellbore drilling tool during the second drilling operation.

11. The method of claim 7, wherein determining the degree of difference between the first symbolic representation and the second symbolic representation comprises using democratized symbolic dynamics on at least two different time scales to determine the degree of difference.

12. The method of claim 7, wherein determining the degree of difference between the first symbolic representation and the second symbolic representation comprises determining, based at least in part on the degree of difference, whether the anomaly is present in the subsequent data signal.

13. A non-transitory computer-readable medium comprising instructions that are executable by a processing device for causing the processing device to perform operations comprising:

receiving a baseline data signal about a downhole tool and a subsequent data signal about the downhole tool, the downhole tool positionable in a wellbore associated with a wellbore operation;

transforming the baseline data signal and the subsequent data signal into a first symbolic representation of the baseline data signal and a second symbolic representation of the subsequent data signal, respectively;

determining, using symbolic dynamics to compare the first symbolic representation to the second symbolic representation, a degree of difference between the first symbolic representation and the second symbolic representation; and controlling the wellbore operation in response to detecting an anomaly from the degree of difference, wherein controlling the wellbore operation comprises providing an output generatable from the degree of difference to a controller of a drill bit and automatically altering, using the output, at least one functional parameter of the drill bit for forming a second wellbore.

14. The non-transitory computer-readable medium of claim 13, wherein the operation of determining the degree of difference between the first symbolic representation and the second symbolic representation comprises determining an entropy between the first symbolic representation and the second symbolic representation.

15. The non-transitory computer-readable medium of claim 13, wherein the wellbore operation includes a second drilling operation, wherein the downhole tool includes a wellbore drilling tool, wherein the baseline data signal includes a baseline vibration data signal of the wellbore drilling tool that represents an expected vibration signal of the wellbore drilling tool, and wherein the subsequent data signal includes a subsequent vibration data signal of the wellbore drilling tool that represents a measured vibration signal of the wellbore drilling tool during the second drilling operation.

16. The non-transitory computer-readable medium of claim 13, wherein the operation of determining the degree of difference between the first symbolic representation and the second symbolic representation comprises using democratized symbolic dynamics on at least two different time scales to determine the degree of difference.

17. The non-transitory computer-readable medium of claim 13, wherein the operation of determining the degree of difference between the first symbolic representation and the second symbolic representation comprises determining, based at least in part on the degree of difference, whether the anomaly is present in the subsequent data signal.

* * * * *